US011551603B2

(12) United States Patent
Park et al.

(10) Patent No.: US 11,551,603 B2
(45) Date of Patent: Jan. 10, 2023

(54) DISPLAY APPARATUS WITH FREQUENCY CONTROLLER TO DETERMINE DRIVING FREQUENCY BASED ON INPUT IMAGE DATA AND PLAY SPEED SETTING, AND METHOD OF DRIVING DISPLAY PANEL USING THE SAME

(71) Applicant: Samsung Display Co., Ltd., Yongin-Si (KR)

(72) Inventors: Sehyuk Park, Seongnam-si (KR); Hongsoo Kim, Hwaseong-si (KR); Jinyoung Roh, Hwaseong-si (KR); Hyojin Lee, Seongnam-si (KR); Jaekeun Lim, Suwon-si (KR)

(73) Assignee: SAMSUNG DISPLAY CO., LTD., Gyeonggi-do (KR)

( * ) Notice: Subject to any disclaimer, the term of this patent is extended or adjusted under 35 U.S.C. 154(b) by 0 days.

(21) Appl. No.: 17/212,392

(22) Filed: Mar. 25, 2021

(65) Prior Publication Data

US 2022/0013059 A1 Jan. 13, 2022

(30) Foreign Application Priority Data

Jul. 8, 2020 (KR) ..... 10-2020-0084198

(51) Int. Cl.
*G09G 3/20* (2006.01)

(52) U.S. Cl.
CPC ..... *G09G 3/2092* (2013.01); *G09G 2310/027* (2013.01); *G09G 2320/02* (2013.01)

(58) Field of Classification Search
None
See application file for complete search history.

(56) References Cited

U.S. PATENT DOCUMENTS

| | | | | |
|---|---|---|---|---|
| 10,009,628 | B2 | 6/2018 | Bushell et al. | |
| 2009/0278766 | A1* | 11/2009 | Sako | G06T 15/80 345/592 |
| 2013/0038621 | A1* | 2/2013 | Choi | G06T 1/60 345/589 |
| 2017/0018234 | A1* | 1/2017 | Na | G09G 3/3406 |
| 2017/0075416 | A1* | 3/2017 | Armstrong | H04L 65/1063 |
| 2020/0252581 | A1* | 8/2020 | Zhong | G06F 3/14 |

FOREIGN PATENT DOCUMENTS

| | | | |
|---|---|---|---|
| KR | 1020070026249 | A | 3/2007 |
| KR | 1020150094881 | A | 8/2015 |

* cited by examiner

*Primary Examiner* — Chad M Dicke
(74) *Attorney, Agent, or Firm* — Cantor Colburn LLP

(57) ABSTRACT

A display apparatus includes a display panel, a data driver and a frequency controller. The display panel displays an image based on an input image data. The data driver outputs a data voltage to the display panel. The frequency controller determines a driving frequency of the display panel based on the input image data and a play speed setting.

17 Claims, 10 Drawing Sheets

FIG. 4

| STAGE | INPUT GRAYSCALE VALUE (8bits) | FLICKER LUT VALUE | FIRST FREQUENCY(Hz) |
|---|---|---|---|
| 1 | 0-3 | 0 | 1 |
| 2 | 4-7 | 0 | 1 |
| 3 | 8-11 | 40 | 2 |
| 4 | 12-15 | 80 | 5 |
| 5 | 16-19 | 120 | 10 |
| 6 | 20-23 | 160 | 30 |
| 7 | 24-27 | 200 | 60 |
| ⋮ | ⋮ | ⋮ | ⋮ |
| 60 | 236-239 | 0 | 1 |
| 61 | 240-243 | 0 | 1 |
| 62 | 244-247 | 0 | 1 |
| 63 | 248-251 | 0 | 1 |
| 64 | 252-255 | 0 | 1 |

FIG. 5

| PLAY SPEED | INPUT FREQUENCY(Hz) | SECOND FREQUENCY(Hz) |
|---|---|---|
| 1.0x | 60 | 60 |
| 0.8x | 60 | 48 |
| 0.6x | 60 | 36 |
| 0.5x | 60 | 30 |
| 0.4x | 60 | 24 |
| 0.2x | 60 | 12 |
| 0.1x | 60 | 6 |

DISPLAY APPARATUS WITH FREQUENCY CONTROLLER TO DETERMINE DRIVING FREQUENCY BASED ON INPUT IMAGE DATA AND PLAY SPEED SETTING, AND METHOD OF DRIVING DISPLAY PANEL USING THE SAME

This application claims priority to Korean Patent Application No. 10-2020-0084198, filed on Jul. 8, 2020, and all the benefits accruing therefrom under 35 U.S.C. § 119, the content of which in its entirety is herein incorporated by reference.

BACKGROUND

1. Field

Embodiments of the invention relate to a display apparatus and a method of driving a display panel of the display apparatus. More particularly, embodiments of the invention relate to a display apparatus with reduced power consumption and enhanced display quality and a method of driving a display panel of the display apparatus.

2. Description of the Related Art

A method to minimize a power consumption of an information technology ("IT") product such as a tablet personal computer ("PC") and a note PC have been studied.

To minimize the power consumption of the IT product which includes a display panel, a power consumption of the display panel may be desired to be minimized. The display apparatus may include a frequency controlling part to drive the display panel in a relatively low driving frequency when the display panel displays a static image.

SUMMARY

In an actual user environment of using a display apparatus, a display panel of the display apparatus may display a moving image more frequently than a static image, and is often used for viewing interne lectures for learning. In this case, the power consumption of the display apparatus may not be sufficiently reduced.

Embodiments of the invention provide a display apparatus capable of reducing a power consumption of the display apparatus and enhancing a display quality of a display panel.

Embodiments of the invention also provide a method of driving a display panel using the display apparatus.

In an embodiment of a display apparatus according to the invention, the display apparatus includes a display panel, a data driver and a frequency controller. In such an embodiment, the display panel displays an image based on an input image data, the data driver outputs a data voltage to the display panel, and the frequency controller determines a driving frequency of the display panel based on the input image data and a play speed setting.

In an embodiment, the frequency controller may include a play mode determiner which determines whether the play speed setting is less than 1.0 times, a static image determiner which determines whether the input image data is a static image or a moving image when the play speed setting is equal to or greater than 1.0 times, a flicker value storage which stores a flicker value with respect to a grayscale value of the input image data, and a driving frequency determiner which determines the driving frequency of the display panel based on the flicker value and the play speed setting.

In an embodiment, the driving frequency determiner may include a first frequency determiner which determines a first frequency based on the flicker value, a second frequency determiner which determines a second frequency based on the play speed setting, and a frequency comparator which compares the first frequency and the second frequency and determines that the driving frequency of the display panel is a greater value among the first frequency and the second frequency.

In an embodiment, the first frequency may be determined based on the flicker value representing a degree of a flicker occurrence for the grayscale value of the input image data. In such an embodiment, when the degree of the flicker occurrence is high, the first frequency may be set to be high. In such an embodiment, when the degree of the flicker occurrence is low, the first frequency may be set to be low.

In an embodiment, the second frequency may be determined by multiplying the play speed setting to an input frequency of the input image data. When the play speed setting is high, the second frequency may be set to be high. When the play speed setting is low, the second frequency may be set to be low.

In an embodiment, when the play speed setting is less than 1.0 times, the driving frequency determiner may determine the first frequency and the second frequency.

In an embodiment, when the play speed setting is less than 1.0 times and the first frequency is equal to or greater than the second frequency, the driving frequency determiner may output a data signal to the data driver in the first frequency. In such an embodiment, when the play speed setting is less than 1.0 times and the first frequency is less than the second frequency, the driving frequency determiner may output the data signal to the data driver in the second frequency.

In an embodiment, when the input image data is a static image and the play speed setting is less than 1.0 times, the driving frequency determiner may determine the driving frequency of the display panel based on the flicker value.

In an embodiment, the display panel may include a plurality of segments. In such an embodiment, the frequency controller may include a play mode determiner which determines whether the play speed setting is less than 1.0 times, a static image determiner which determines whether the input image data is a static image or a moving image when the play speed setting is equal to or greater than 1.0 times, a flicker value storage which stores a flicker value with respect to a grayscale value of the input image data, and a driving frequency determiner which determines the driving frequency of the display panel based on flicker values corresponding to the segments and the play speed setting.

In an embodiment, the frequency controller may determine the flicker values of the respective segments and determine that the driving frequency of the display panel is a maximum driving frequency in which a flicker is not shown to a user based on the flicker values of the respective segments.

In an embodiment of a method of driving a display panel, the method includes determining a driving frequency of the display panel using a frequency controller and outputting a data voltage to the display panel based on the driving frequency. In such an embodiment, the frequency controller determines the driving frequency of the display panel based on an input image data and a play speed setting.

In an embodiment, the determining the driving frequency of the display panel may include determining whether the input image data is a moving image or a static image when the play speed setting is equal to or greater than 1.0 times.

In an embodiment, the determining the driving frequency of the display panel may further include determining that the driving frequency of the display panel is an input frequency of the input image data when the play speed setting is equal to or greater than 1.0 times and the input image data is a moving image, and determining the driving frequency of the display panel based on a flicker value with respect to a grayscale value of the input image data when the play speed setting is equal to or greater than 1.0 times and the input image data is a static image.

In an embodiment, the determining the driving frequency of the display panel may include determining a first frequency based on a flicker value with respect to a grayscale value of the input image data and a second frequency based on the play speed setting when the play speed setting is less than 1.0 times.

In an embodiment, the determining the driving frequency of the display panel may further include determining that the driving frequency of the display panel is the first frequency when the play speed setting is less than 1.0 times and the first frequency is equal to or greater than the second frequency, and determining that the driving frequency of the display panel is the second frequency when the play speed setting is less than 1.0 times and the first frequency is less than the second frequency.

In an embodiment, the first frequency may be determined based on the flicker value representing a degree of a flicker occurrence for the grayscale value of the input image data. In such an embodiment, when the degree of the flicker occurrence is high, the first frequency may be set to be high. In such an embodiment, when the degree of the flicker occurrence is low, the first frequency may be set to be low.

In an embodiment, the second frequency may be determined by multiplying the play speed setting to an input frequency of the input image data. When the play speed setting is high, the second frequency may be set to be high. When the play speed setting is low, the second frequency may be set to be low.

In an embodiment, the driving frequency of the display panel may be determined based on a flicker value with respect to a grayscale value of the input image data when the input image data is a static image or the play speed setting is less than 1.0 times.

In an embodiment, the method of driving the display panel may further include dividing the display panel into a plurality of segments and determining flicker values corresponding to the segments. In such an embodiment, the driving frequency of the display panel may be determined based on the flicker values corresponding to the segments and the play speed setting.

According to embodiment of the display apparatus and the method of driving the display panel of the display apparatus, the frequency controller may determine the driving frequency based on the input image data and the play speed setting. Thus, when the input image data represents a static image or when the moving image having the play speed setting which is lower than 1.0 times, the driving frequency may be set to be lower than the input frequency. Thus, the power consumption of the display apparatus may be reduced.

In such embodiments, the driving frequency of the display panel is determined based on the degree of the flicker of the input image data so that the display quality of the display panel may be enhanced.

BRIEF DESCRIPTION OF THE DRAWINGS

The above and other features of the invention will become more apparent by describing in detailed embodiments thereof with reference to the accompanying drawings, in which:

FIG. 4 is a table illustrating an embodiment of a flicker value storage of FIG. 2;

FIG. 5 is a table illustrating an embodiment of second frequencies determined by the driving frequency determiner of FIG. 2;

DETAILED DESCRIPTION

Figure 1:
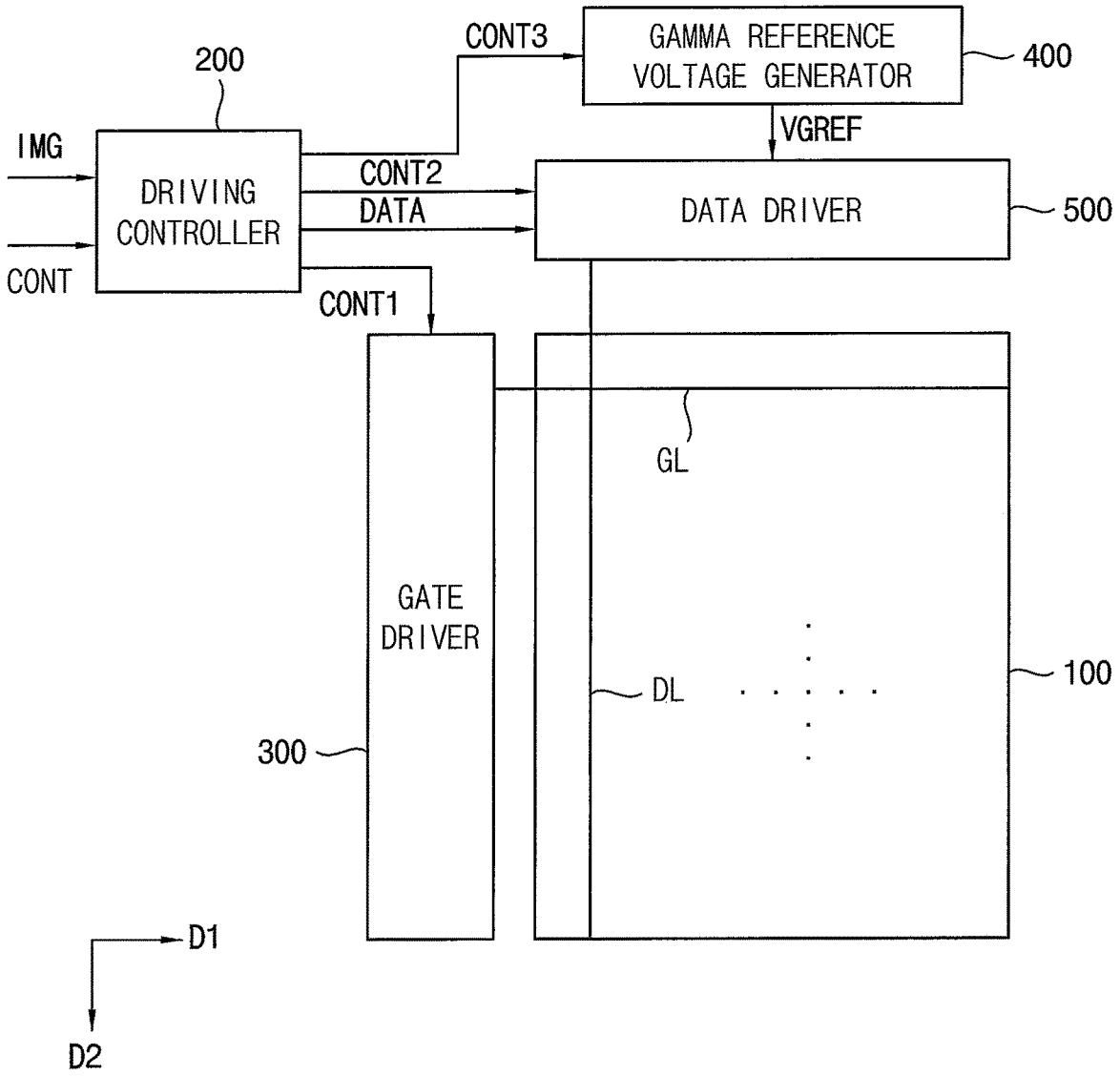
FIG. 1 is a block diagram illustrating a display apparatus according to an embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, "a", "an," "the," and "at least one" do not denote a limitation of quantity, and are intended to include both the singular and plural, unless the context clearly indicates otherwise. For example, "an element" has the same meaning as "at least one element," unless the context clearly indicates otherwise. "At least one" is not to be construed as limiting "a" or "an." "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The terms "below" or "beneath" can, therefore, encompass both an orientation of above and below.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, embodiments of the invention will be described in detail with reference to the accompanying drawings.

FIG. 1 is a block diagram illustrating a display apparatus according to an embodiment of the invention.

Referring to FIG. 1, an embodiment of the display apparatus includes a display panel 100 and a display panel driver. The display panel driver includes a driving controller 200, a gate driver 300, a gamma reference voltage generator 400 and a data driver 500.

In one embodiment, for example, the driving controller 200 and the data driver 500 may be integrally formed as a single unit or circuit. In one embodiment, for example, the driving controller 200, the gamma reference voltage generator 400 and the data driver 500 may be integrally formed as a single unit or circuit. A driving module including the driving controller 200 and the data driver 500, which are integrally formed, may be referred to as a timing controller embedded data driver ("TED").

In an embodiment, the display panel 100 includes a plurality of gate lines GL, a plurality of data lines DL and a plurality of pixels connected to the gate lines GL and the data lines DL. The gate lines GL extend in a first direction D1, and the data lines DL extend in a second direction D2 crossing the first direction D1.

In one embodiment, for example, the display panel 100 may be an organic light emitting display panel including an organic light emitting element. In such an embodiment, each pixel may include an organic light emitting diode OLED.

The pixel receives a data write gate signal, a data initialization gate signal, an organic light emitting element initialization signal, a data voltage and an emission signal, and the organic light emitting diode of the pixel emits light corresponding to the level of the data voltage to display the image.

In an embodiment, the pixel may include a switching element of a first type. In one embodiment, for example, the switching element of the first type may be a polysilicon thin film transistor. In one embodiment, for example, the switching element of the first type may be a low temperature polysilicon ("LTPS") thin film transistor. In one embodiment, for example, the switching element of the first type may be a P-type transistor.

In an embodiment, the pixel may include a switching element of a first type and a switching element of a second type different from the first type. In one embodiment, for example, the switching element of the first type may be a polysilicon thin film transistor. In one embodiment, for example, the switching element of the first type may be a low temperature polysilicon ("LTPS") thin film transistor. In one embodiment, for example, the switching element of the second type may be an oxide thin film transistor. In one embodiment, for example, the switching element of the first type may be a P-type transistor, and the switching element of the second type may be an N-type transistor.

Alternatively, the display panel 100 may be a liquid crystal display panel including a liquid crystal layer.

The driving controller 200 receives input image data IMG and an input control signal CONT from an external apparatus. In an embodiment, the input image data IMG may include red image data, green image data and blue image data. The input image data IMG may include white image data. Alternatively, the input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA, based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

In one embodiment, for example, the driving controller 200 may adjust a driving frequency of the display panel 100 based on the input image data IMG.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 will be described later in detail referring to FIGS. 2 to 8.

The gate driver 300 generates gate signals for driving the gate lines GL in response to the first control signal CONT1 received from the driving controller 200. The gate driver 300 outputs the gate signals to the gate lines GL. In one embodiment, for example, the gate driver 300 may sequentially output the gate signals to the gate lines GL.

The display panel 100 may include a display region and a peripheral region adjacent to the display region. In one embodiment, for example, the gate driver 300 may be mounted on a peripheral region of the display panel 100. In one embodiment, for example, the gate driver 300 may be integrated on a peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed or included in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

In one embodiment, for example, the data driver 500 may be mounted on a peripheral region of the display panel 100. In one embodiment, for example, the data driver 500 may be integrated on a peripheral region of the display panel 100.

Figure 2:
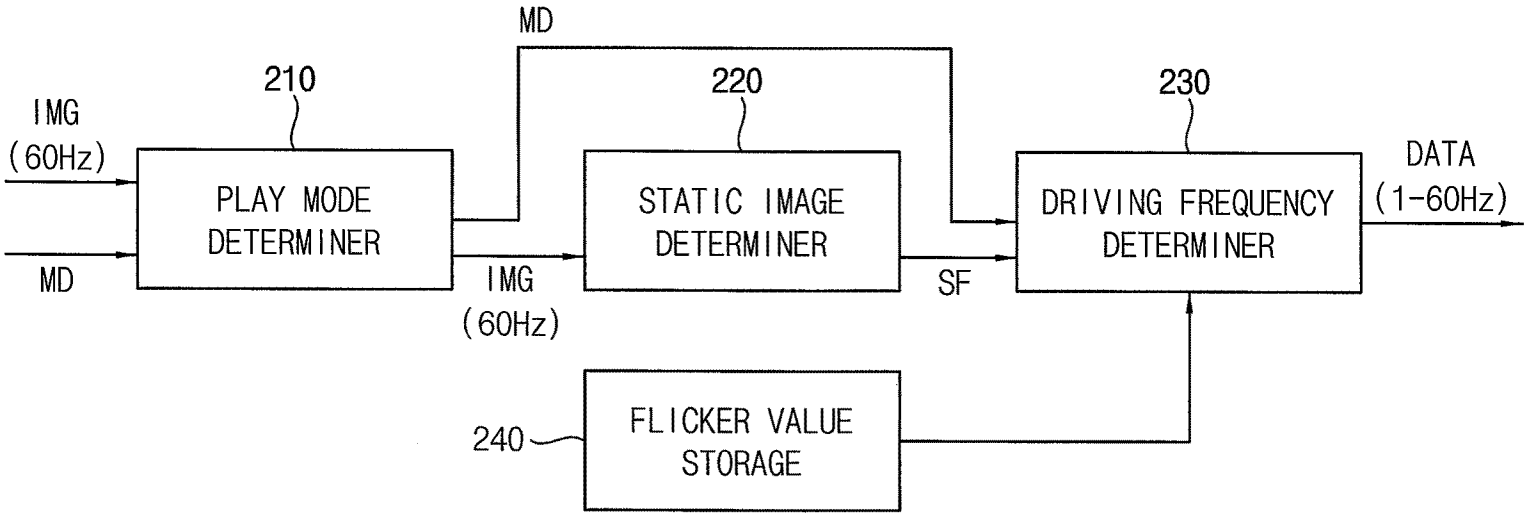
FIG. 2 is a block diagram illustrating an embodiment of a frequency controller in a driving controller of FIG. 1.
Figure 3:
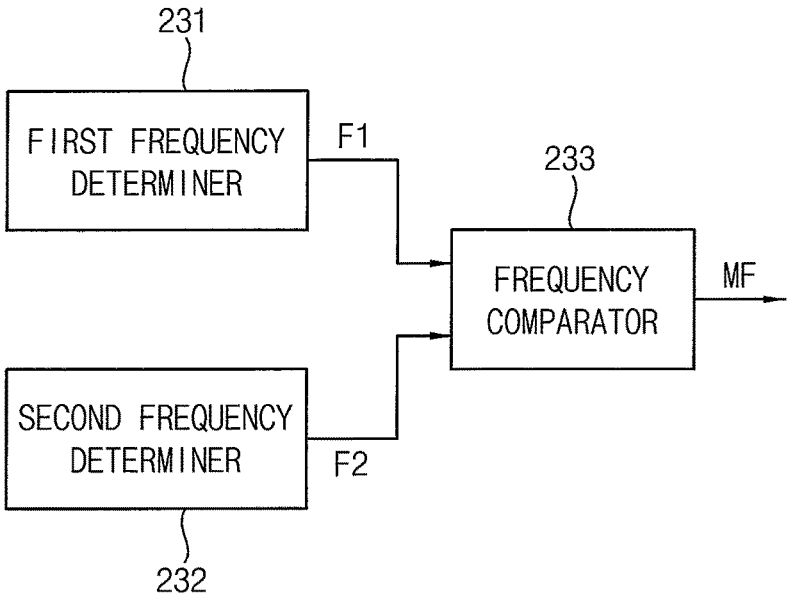
FIG. 3 is a block diagram illustrating an embodiment of a driving frequency determiner of FIG. 2.

FIG. 2 is a block diagram illustrating an embodiment of a frequency controller in the driving controller 200 of FIG. 1. FIG. 3 is a block diagram illustrating an embodiment of a driving frequency determiner 230 of FIG. 2. FIG. 4 is a table illustrating an embodiment of a flicker value storage 240 of FIG. 2. FIG. 5 is a table illustrating an embodiment of second frequencies determined by the driving frequency determiner 230 of FIG. 2.

Referring to FIGS. 1 to 5, an embodiment of the driving controller 200 includes a frequency controller. The frequency controller may determine the driving frequency of the display panel 100 based on the input image data IMG and a play speed setting MD.

In an embodiment, as shown in FIG. 2, the frequency controller may include a play mode determiner 210, a static image determiner 220, a driving frequency determiner 230 and a flicker value storage 240.

The play mode determiner 210 receives the play speed setting MD. The play speed setting MD may represent a play speed of the image. The play speed setting MD may be set by a user. In one embodiment, for example, the play speed setting MD may have one of a value of 3.0 times, 2.5 times, 2.0 times, 1.8 times, 1.6 times, 1.4 times, 1.2 times, 1.0 times, 0.8 times, 0.6 times, 0.5 times, 0.4 times, 0.2 times and 0.1, but not being limited thereto.

The play mode determiner 210 may determine whether the play speed setting MD is lower than 1.0 times. In an embodiment, when the play speed setting MD is lower than 1.0 times, the operation of the static image determiner 220 may be skipped. In such an embodiment, when the play speed setting MD is lower than 1.0 times, the play mode determiner 210 may output the play speed setting MD to the driving frequency determiner 230.

The static image determiner 220 may determine whether the input image data IMG is a static image or a moving image. The static image determiner 220 may output a static image flag SF representing whether the input image data IMG is the static image or the moving image to the driving frequency determiner 230. In one embodiment, for example, when the input image data IMG is the static image, the static image determiner 220 may output the static image flag SF of 1 to the driving frequency determiner 230. In such an embodiment, when the input image data IMG is the moving image, the static image determiner 220 may output the static image flag SF of 0 to the driving frequency determiner 230. In an embodiment, when the display panel 100 is operated in always on mode, the static image determiner 220 may output the static image flag SF of 1 to the driving frequency determiner 230.

In an embodiment, the static image determiner 220 may determine whether the input image data IMG is a static image or a moving image when the play speed setting MD is equal to or higher than 1.0 times.

In one embodiment, for example, when the static image flag SF is 1, the driving frequency determiner 230 may drive the switching elements in the pixel in a low driving frequency.

In such an embodiment, when the static image flag SF is 0, the driving frequency determiner 230 may drive the switching elements in the pixel in a normal driving frequency.

The driving frequency determiner 230 may refer to the flicker value storage 240 to determine the low driving frequency. The flicker value storage 240 may store a flicker value representing a degree of a flicker corresponding to a grayscale value of the input image data IMG.

In an embodiment, as shown in FIG. 3, the driving frequency determiner 230 may include a first frequency determiner 231 that determines a first frequency F1 based on the flicker value, a second frequency determiner 232 that determines a second frequency F2 based on the play speed setting MD, and a frequency comparator 233 that compares the first frequency F1 and the second frequency F2 and determines (or set) a greater value among the first frequency F1 and the second frequency F2 as the driving frequency MF of the display panel 100.

In an embodiment, the driving frequency determiner 230 may determine the first frequency F1 and the second frequency F2 when the play speed setting MD is lower than 1.0 times.

In an embodiment, when the play speed setting MD is lower than 1.0 times and the first frequency F1 is greater than or equal to the second frequency F2, the driving frequency determiner 230 may determine or set the driving frequency MF of the display panel 100 to the first frequency F1, and the driving frequency determiner 230 may output the data signal DATA to the date driver 500 in the first frequency F1. If the first frequency F1 is greater than or equal to the second frequency F2, the output image may generate the flicker when the image is displayed at the second frequency F2 determined by the play speed setting MD. Thus, the output image may be displayed in the first frequency F1 not to cause the flicker.

In an embodiment, when the play speed setting MD is lower than 1.0 times and the first frequency F1 is less than the second frequency F2, the driving frequency determiner 230 may determine or set the driving frequency MF of the display panel 100 to the second frequency F2, and the driving frequency determiner 230 may output the data signal DATA to the date driver 500 in the second frequency F2. If the first frequency F1 is less than the second frequency F2, the output image may not generate the flicker when the image is displayed at the second frequency F2 determined by the play speed setting MD. Thus, the output image may be displayed in the second frequency F2 in this case.

The first frequency F1 may be determined based on the flicker value which represents a degree of the flicker occurrence for the grayscale value of the input image data IMG.

In one embodiment, for example, when the degree of the flicker occurrence is high, the first frequency F1 may be set to be high. In such an embodiment, when the degree of the flicker occurrence is low, the first frequency F1 may be set to be low.

The flicker value storage 240 may store the grayscale value of the input image data IMG and the flicker value corresponding to the grayscale value of the input image data IMG. The flicker value may be used for determining the first frequency F1 of the display panel 100. In one embodiment, for example, the flicker value storage 240 may include a type of a lookup table (referred to as "LUT" in FIG. 4).

In an embodiment, as shown in FIG. 4, the input grayscale value of the input image data IMG may be 8 bits, the minimum grayscale value of the input image data IMG may be 0 and the maximum grayscale value of the input image data IMG may be 255. The number of flicker setting stages of the flicker value storage 240 may be 64. When the number of the flicker setting stages increases, the flicker may be effectively removed but a logic size of the driving controller 200 may increase. Thus, the number of the flicker setting stages may be less than a predetermined value.

In an embodiment, the input grayscale value of the input image data IMG is 8 bits as shown in FIG. 4, but the invention may not be limited thereto.

In an embodiment, as shown in FIG. 4, the number of the grayscale values of the input image data IMG is 256 and the number of the flicker setting stages is 64 so that a single flicker value in the flicker value storage 240 may correspond to four grayscale values. In one embodiment, for example, a first flicker setting stage stores the flicker value of 0 for the grayscale values of 0 to 3. Herein, the flicker value of 0 may represent the driving frequency of 1 hertz (Hz). In one embodiment, for example, a second flicker setting stage stores the flicker value of 0 for the grayscale values of 4 to 7. Herein, the flicker value of 0 may represent the driving frequency of 1 Hz. In one embodiment, for example, a third flicker setting stage stores the flicker value of 40 for the grayscale values of 8 to 11. Herein the flicker value of 40 may represent the driving frequency of 2 Hz. In one embodiment, for example, a fourth flicker setting stage stores the flicker value of 80 for the grayscale values of 12 to 15. Herein, the flicker value of 80 may represent the driving frequency of 5 Hz. In one embodiment, for example, a fifth flicker setting stage stores the flicker value of 120 for the grayscale values of 16 to 19. Herein, the flicker value of 120 may represent the driving frequency of 10 Hz. In one embodiment, for example, a sixth flicker setting stage stores the flicker value of 160 for the grayscale values of 20 to 23. Herein, the flicker value of 160 may represent the driving frequency of 30 Hz. In one embodiment, for example, a seventh flicker setting stage stores the flicker value of 200 for the grayscale values of 24 to 27. Herein, the flicker value of 200 may represent the driving frequency of 60 Hz. In one embodiment, for example, a sixty second flicker setting stage stores the flicker value of 0 for the grayscale values of 244 to 247. Herein, the flicker value of 0 may represent the driving frequency of 1 Hz. In one embodiment, for example, a sixty third flicker setting stage stores the flicker value of 0 for the grayscale values of 248 to 251. Herein, the flicker value of 0 may represent the driving frequency of 1 Hz. In one embodiment, for example, a sixty fourth flicker setting stage stores the flicker value of 0 for the grayscale values of 252 to 255. Herein, the flicker value of 0 may represent the driving frequency of 1 Hz.

The second frequency F2 may be determined by multiplying the play speed setting MD to an input frequency of the input image data IMG. In such an embodiment, when the play speed setting MD is high, the second frequency F2 may be set to be high. In such an embodiment, when the play speed setting MD is low, the second frequency F2 may be set to be low.

In an embodiment, as shown in FIG. 5, when the play speed setting MD is 1.0 times and the input frequency is 60 Hz, the second frequency may be 60 Hz. When the play speed setting MD is 0.8 times and the input frequency is 60 Hz, the second frequency may be 48 Hz (=60 Hz×0.8). When the play speed setting MD is 0.6 times and the input frequency is 60 Hz, the second frequency may be 36 Hz (=60 Hz*0.6). When the play speed setting MD is 0.5 times and the input frequency is 60 Hz, the second frequency may be 30 Hz (=60 Hz×0.5). When the play speed setting MD is 0.4 times and the input frequency is 60 Hz, the second frequency may be 24 Hz (=60 Hz×0.4). When the play speed setting MD is 0.2 times and the input frequency is 60 Hz, the second frequency may be 12 Hz (=60 Hz×0.2). When the play speed setting MD is 0.1 times and the input frequency is 60 Hz, the second frequency may be 6 Hz (=60 Hz×0.1).

Figure 6:
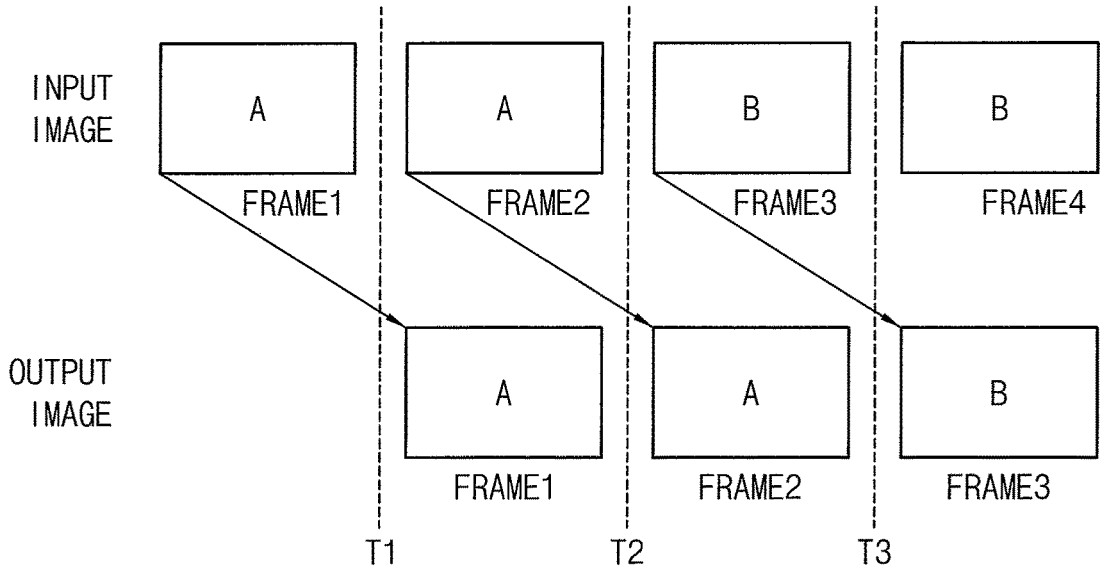
FIG. 6 is a conceptual diagram illustrating an output image and a driving frequency according to a comparative embodiment when a play speed setting is 0.5 times.
Figure 7:
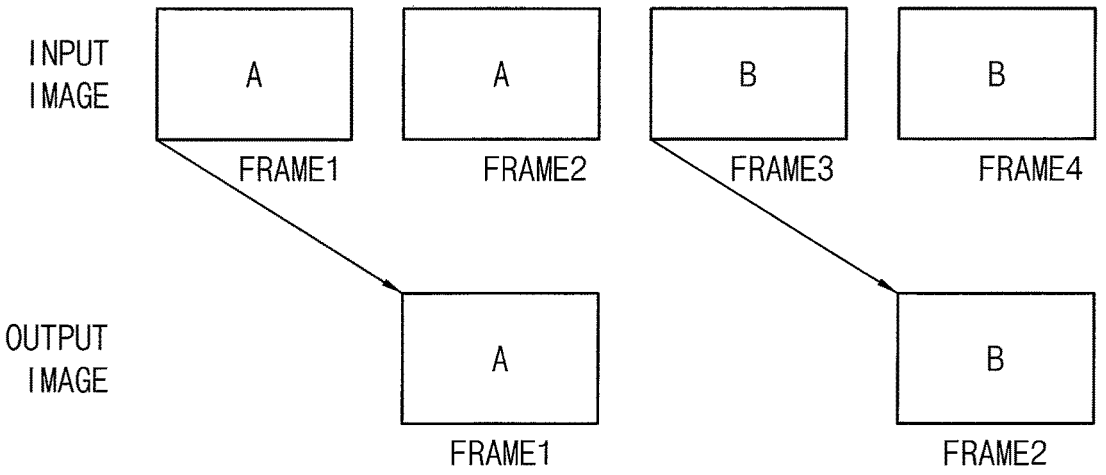
FIG. 7 is a conceptual diagram illustrating an output image and a driving frequency according to an operation of the driving controller of FIG. 2 when the play speed setting is 0.5 times.

FIG. 6 is a conceptual diagram illustrating an output image and a driving frequency according to a comparative embodiment when a play speed setting MD is 0.5 times. FIG. 7 is a conceptual diagram illustrating an output image and a driving frequency according to an operation of the driving controller of FIG. 2 when the play speed setting MD is 0.5 times.

FIG. 6 represents a comparative embodiment of the frequency controller including the static image determiner 220, the driving frequency determiner 230 and the flicker value storage 240 but not including the play mode determiner 210.

In the comparative embodiment of FIG. 6, when the play speed setting MD is set to 0.5 times, the driving controller 200 may copy each of input images A and B two times so that the driving controller 200 may process the input images in a type of A, A, B and B.

When the input image A is inputted in a first frame FRAME1 and the input image A is inputted in a second frame FRAME2, the static image determiner 220 according to the comparative embodiment may determine that the input image data IMG is a static image at the end of the second frame FRAME2. Thus, the second frame FRAME2 of the output image may be a first frame of the low frequency driving.

However, when the input image A is inputted in the second frame FRAME2 and the input image B is inputted in a third frame FRAME3, the static image determiner 220 according to the comparative embodiment may determine that the input image data IMG is a moving image at the end of the third frame FRAME3. Thus, in the third frame FRAME3 of the output image, the low frequency driving mode is immediately terminated.

Since the static image determiner 220 of the comparative embodiment of FIG. 6 operates based on at least two frames to determine the low frequency driving, when the play speed setting MD is 0.5 times, the low frequency driving is substantially impossible.

In addition, the driving controller 200 may include a dithering part which extends the number of bits of the input image data IMG or the data signal DATA to increase a grayscale resolution of the input image data IMG or the data signal DATA. The dithering part may operate a dithering operation, for example. The dithering part may reconstitute an image signal generated by extracting upper bits of the input image data IMG or the data signal DATA corresponding to bits processible in the driving controller 200 or the data driver 500 based on a selected dithering pattern based on lower bits in a unit of frame. In one embodiment, for example, the dithering pattern may be a set of compensating values corresponding to pixels. By the dithering operation, the luminance of the display panel may be slightly adjusted so that the grayscale resolution may be enhanced. The dithering part may store a plurality of dithering patterns which vary according to grayscales and frames to use for the dithering operation. The dithering patterns may be repetitive in a number of frames and the dithering patterns may have a repetitive cycle.

In a case where the driving controller 200 further includes the dithering part, since the static image determiner 220 operates based on more than two frames to determine the low frequency driving, even when the play speed setting MD is lower than 0.5 times, the low frequency driving is substantially impossible.

FIG. 7 represents an operation of the frequency controller of an embodiment, when the play speed setting MD is 0.5 times. In an embodiment, as shown in FIG. 7, when the play speed setting MD is set to 0.5 times, the driving controller 200 may not copy input images A and B, but set the driving frequency (the second frequency) to 30 Hz and process the input image A and B one by one.

If the flicker of the image is generated in the driving frequency of 30 Hz which is determined based on the play speed setting MD, the display panel 100 may be driven in the first frequency (e.g. 40 Hz) which is determined by the first frequency determiner 231.

Figure 8:
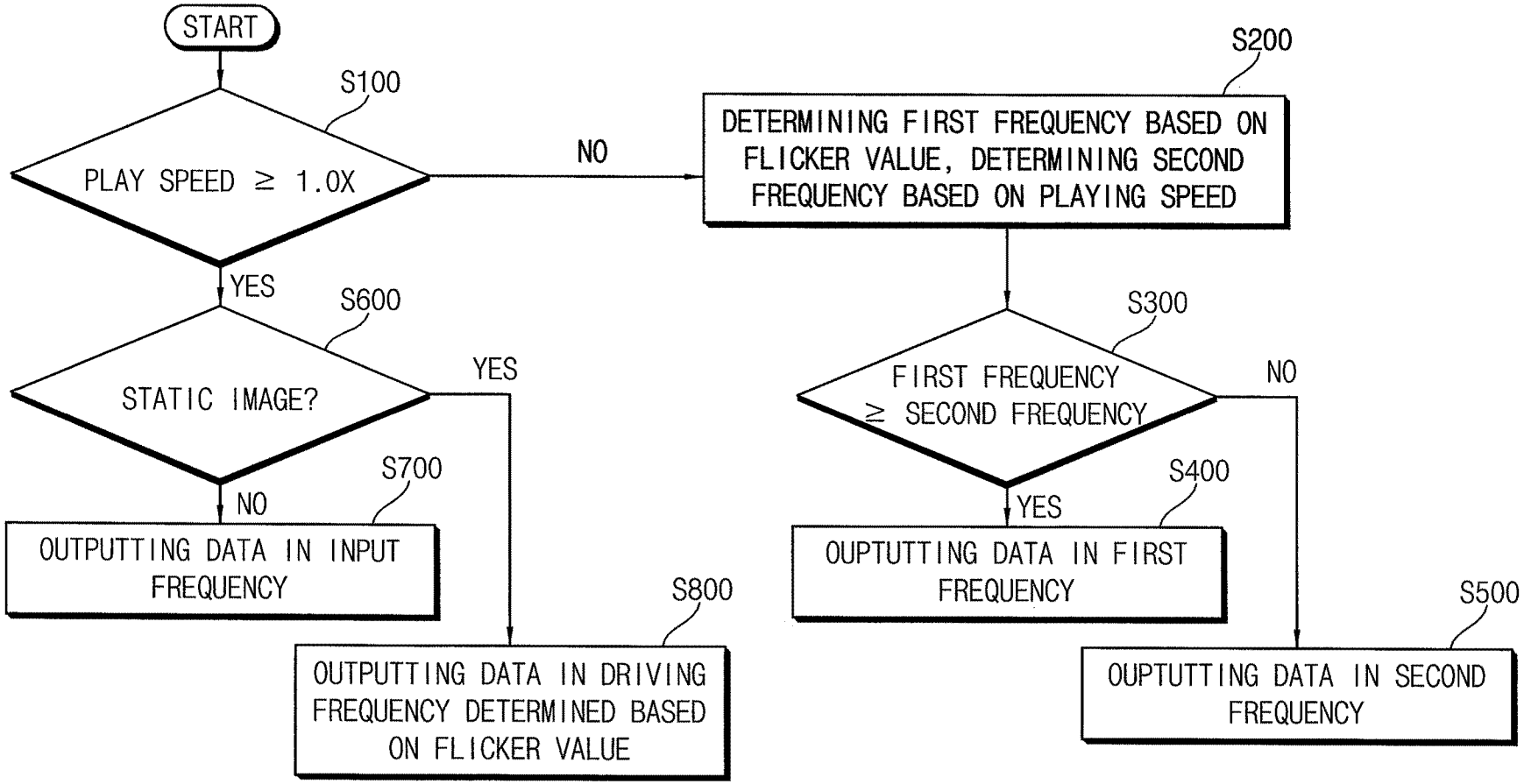
FIG. 8 is a flowchart diagram illustrating an embodiment of an operation of the driving controller of FIG. 2.

FIG. 8 is a flowchart diagram illustrating an embodiment of an operation of the driving controller 200 of FIG. 2.

Referring to FIGS. 1 to 8, an embodiment of the method of driving the display panel 100 may include an operation of determining the driving frequency of the display panel 100 by the frequency controller of the driving controller 200 and an operation of outputting the data voltage to the display panel 100 based on the driving frequency.

The frequency controller may determine the driving frequency of the display panel 100 based on the input image data IMG and the play speed setting MD.

The play mode determiner 210 may determine whether the play speed setting MD is equal to or greater than 1.0 times or not (operation S100).

When the play speed setting MD is equal to or greater than 1.0 times, the static image determiner 220 determines whether the input image data IMG is a moving image or a static image (operation S600).

When the play speed setting MD is equal to or greater than 1.0 times and the input image data IMG is the moving image, the driving frequency determiner 230 may determine the driving frequency of the display panel 100 to the input frequency of the input image data IMG (operation S700).

When the play speed setting MD is equal to or greater than 1.0 times and the input image data IMG is the static image, the driving frequency determiner 230 may determine the driving frequency of the display panel 100 based on the flicker value with respect to the grayscale value of the input image data IMG (operation S800).

When the play speed setting MD is less than 1.0 times, the first frequency determiner 231 determines the first frequency F1 based on the flicker value with respect to the grayscale value of the input image data IMG, and the second frequency determiner 232 determines the second frequency F1 based on the play speed setting MD (operation S200).

The frequency comparator 233 may determine whether the first frequency F1 is equal to or greater than the second frequency F2 (operation S300).

When the play speed setting MD is less than 1.0 times and the first frequency F1 is equal to or greater than the second frequency F2, the driving frequency determiner 230 may determine that the driving frequency of the display panel 100 is the first frequency F1 (operation S400).

When the play speed setting MD is less than 1.0 times and the first frequency F1 is less than the second frequency F2, the driving frequency determiner 230 may determine that the driving frequency of the display panel 100 is the second frequency F2 (operation S500).

According to an embodiment, the frequency controller may determine the driving frequency based on the input image data IMG and the play speed setting MD. Thus, when the input image data IMG represents a static image or when the moving image having the play speed setting MD which is lower than 1.0 times, the driving frequency may be set to be lower than the input frequency. Thus, the power consumption of the display apparatus may be reduced.

In such an embodiment, the driving frequency of the display panel 100 is determined based on the degree of the flicker of the input image data IMG so that the display quality of the display panel 100 may be enhanced.

Figure 9:
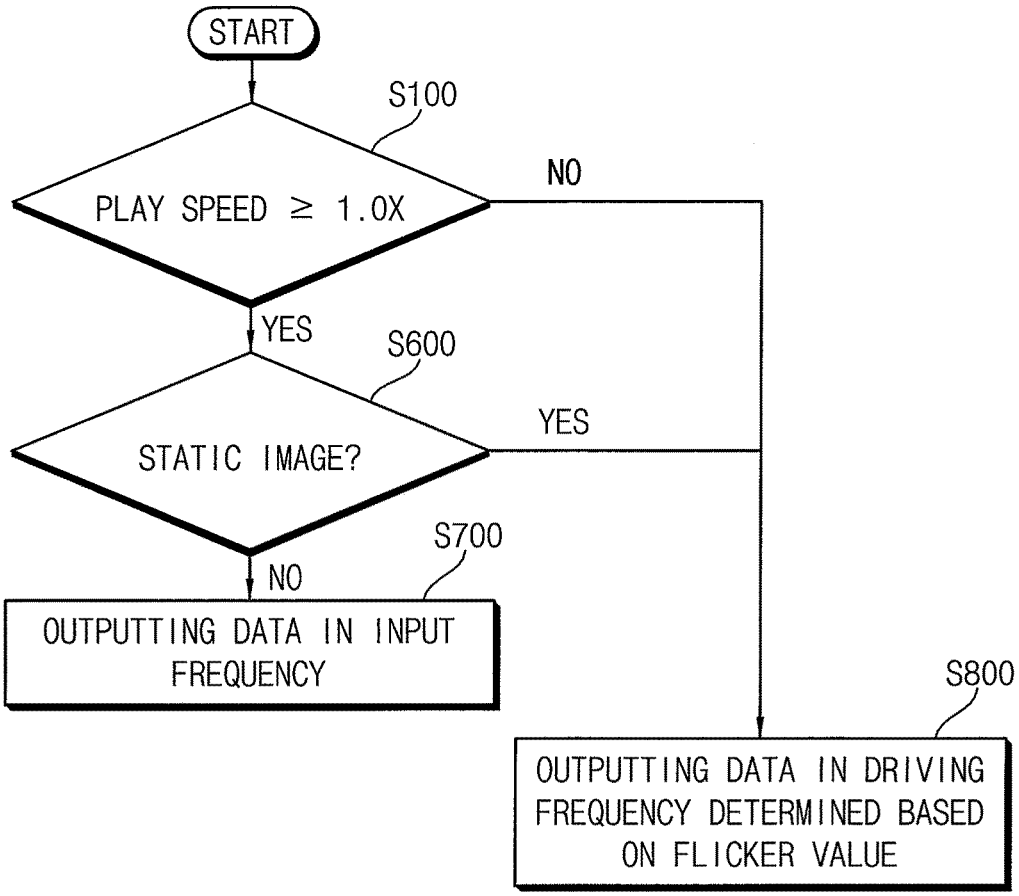
FIG. 9 is a flowchart diagram illustrating an operation of a driving frequency of a display apparatus according to an embodiment of the invention.

FIG. 9 is a flowchart diagram illustrating an operation of a driving frequency of a display apparatus according to an embodiment of the invention.

The display apparatus and the method of driving the display panel of FIG. 9 is substantially the same as the display apparatus and the method of driving the display panel of the previous embodiment described above referring to FIGS. 1 to 8 except for the structure and the operation of the frequency controller. Thus, the same reference numerals will be used to refer to the same or like elements as those of the embodiments described above with reference to FIGS. 1 to 8, and any repetitive detailed description thereof will hereinafter be omitted or simplified.

Referring to FIGS. 1, 2, 4 to 7 and 9, an embodiment of the display apparatus includes a display panel 100 and a display panel driver. The display panel driver includes a driving controller 200, a gate driver 300, a gamma reference voltage generator 400 and a data driver 500.

The driving controller 200 includes a frequency controller. The frequency controller may determine the driving frequency of the display panel 100 based on the input image data IMG and a play speed setting MD.

The frequency controller may include a play mode determiner 210, a static image determiner 220, a driving frequency determiner 230 and a flicker value storage 240.

The play mode determiner 210 may determine whether the play speed setting MD is lower than 1.0 times. In an embodiment, when the play speed setting MD is lower than 1.0 times, the operation of the static image determiner 220 may be skipped. When the play speed setting MD is lower than 1.0 times, the play mode determiner 210 may output the play speed setting MD to the driving frequency determiner 230.

The static image determiner 220 may determine whether the input image data IMG is a static image or a moving image. The static image determiner 220 may output a static image flag SF representing whether the input image data IMG is the static image or the moving image to the driving frequency determiner 230.

The driving frequency determiner 230 may refer to the flicker value storage 240 to determine the low driving frequency. The flicker value storage 240 may store a flicker value representing a degree of a flicker according to a grayscale value of the input image data IMG.

In an embodiment, the driving frequency determiner 230 may use the flicker value to determine the driving frequency. In an embodiment, when the input image data IMG is a static image or the play speed setting MD is less than 1.0 times, the driving frequency determiner 230 may determine the driving frequency of the display panel 100 using the flicker value.

An embodiment of the method of driving the display panel 100 may include an operation of determining the driving frequency of the display panel 100 by the frequency controller of the driving controller 200 and an operation of outputting the data voltage to the display panel 100 based on the driving frequency.

The play mode determiner 210 may determine whether the play speed setting MD is equal to or greater than 1.0 times or not (operation S100).

When the play speed setting MD is equal to or greater than 1.0 times, the static image determiner 220 determines whether the input image data IMG is a moving image or a static image (operation S600).

When the play speed setting MD is equal to or greater than 1.0 times and the input image data IMG is the moving image, the driving frequency determiner 230 may determine that the driving frequency of the display panel 100 is the input frequency of the input image data IMG (operation S700).

When the play speed setting MD is equal to or greater than 1.0 times and the input image data IMG is the static image, the driving frequency determiner 230 may determine the driving frequency of the display panel 100 based on the flicker value with respect to the grayscale value of the input image data IMG (operation S800).

When the play speed setting MD is less than 1.0 times, the driving frequency determiner 230 may determine the driving frequency of the display panel 100 based on the flicker value with reference to the grayscale value of the input image data IMG (operation S800).

According to an embodiment, the frequency controller may determine the driving frequency based on the input image data IMG and the play speed setting MD. Thus, when the input image data IMG represents a static image or when the moving image having the play speed setting MD which is lower than 1.0 times, the driving frequency may be set to be lower than the input frequency. Thus, the power consumption of the display apparatus may be reduced.

In such an embodiment, the driving frequency of the display panel 100 is determined based on the degree of the flicker of the input image data IMG so that the display quality of the display panel 100 may be enhanced.

Figure 10:
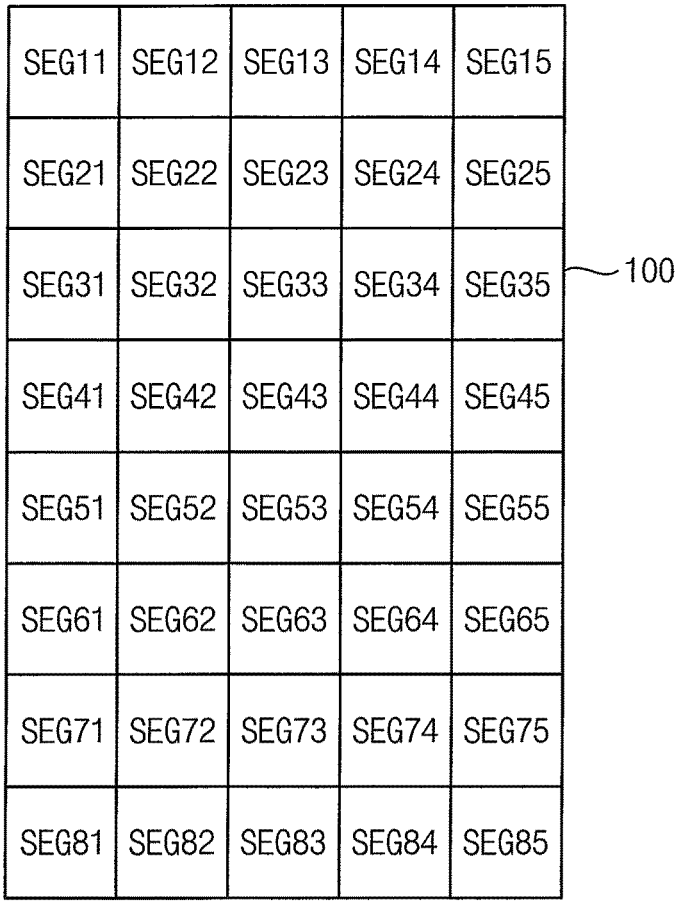
FIG. 10 is a conceptual diagram illustrating a display panel of a display apparatus according to an embodiment of the invention.
Figure 11:
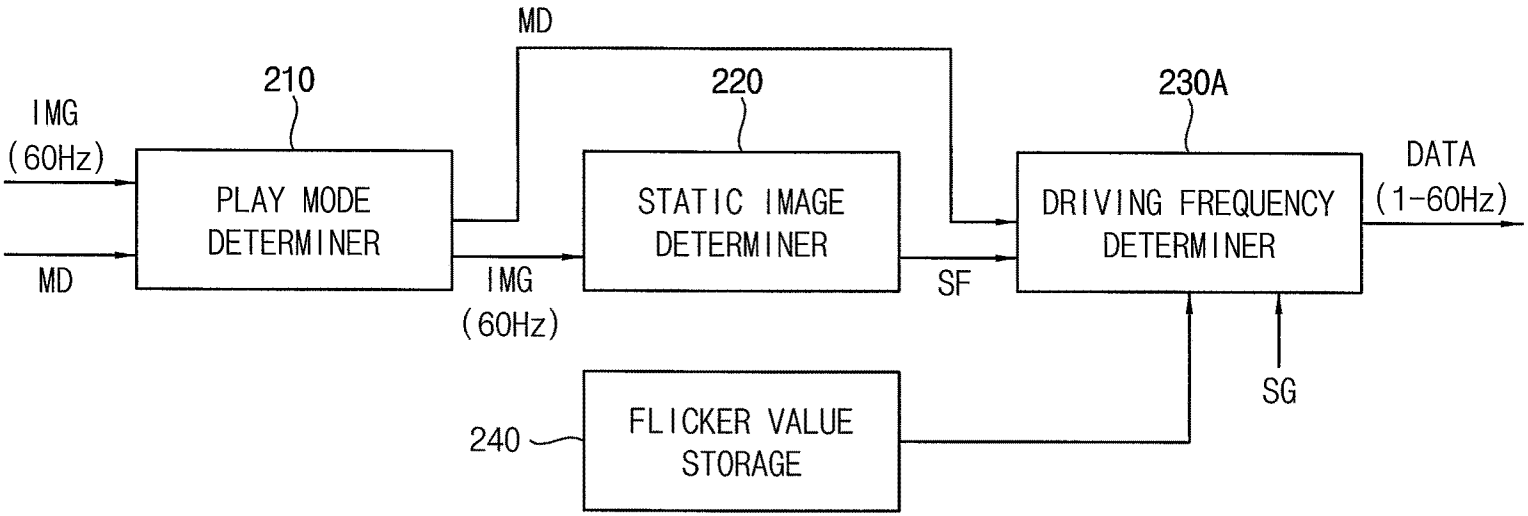
FIG. 11 is a block diagram illustrating a frequency controller the display apparatus of FIG. 10.

FIG. 10 is a conceptual diagram illustrating a display panel 100 of a display apparatus according to an embodiment of the invention. FIG. 11 is a block diagram illustrating a frequency controller the display apparatus of FIG. 10.

The display apparatus and the method of driving the display panel of FIGS. 10 and 11 is substantially the same as the display apparatus and the method of driving the display panel described above referring to FIGS. 1 to 8 except that the display panel is divided into a plurality of segments. Thus, the same reference numerals will be used to refer to the same or like elements as those of the embodiments described above with reference to FIGS. 1 to 8, and any repetitive detailed description thereof will hereinafter be omitted or simplified.

Referring to FIGS. 1, 3 to 8, 10 and 11, the display panel 100 may include a plurality of segments SEG11 to SEG85. In an embodiment, the display panel 100 may include the segments in a form of eight by five matrix as shown in FIG. 10, but the invention is not limited thereto.

When the flicker value is determined for a unit of the pixel and only one pixel has a high flicker value, the entire display panel may be driven in a high driving frequency to prevent the flicker in the one pixel. In one embodiment, for example, when a flicker of only one pixel is prevented in the driving frequency of 30 Hz and the other pixels do not generate the flicker in the driving frequency of 1 Hz, the display panel 100 may be driven in the driving frequency of 30 Hz and the power consumption of the display apparatus may be higher than desired.

Thus, when the display panel 100 is divided into the segments and the flicker value is determined for a unit of the segment, the power consumption of the display apparatus may be effectively reduced.

In one embodiment, for example, the driving controller 200 may include a frequency controller. The frequency controller may include a play mode determiner 210 that determines whether the play speed setting MD is lower than 1.0 times, the static image determiner 220 that determines whether the input image data IMG is a static image or a moving image when the play speed setting MD is equal to or higher than 1.0 times, a flicker value storage 240 that stores a flicker value with respect to a grayscale value of the input image data IMG and a driving frequency determiner 230A that determines the driving frequency of the display panel 100 based on the flicker value corresponding to the segments and the play speed setting MD.

In an embodiment, the driving frequency determiner 230A may determine the flicker values of the respective segments and determine optimal driving frequencies of the respective segments. The driving frequency determiner 230A may determine that the low driving frequency of the display panel 100 is the maximum driving frequency among the optimal driving frequencies of the respective segments. The driving frequency determiner 230A may determine the maximum driving frequency in which a flicker is not shown to a user to the driving frequency of the display panel based on the flicker values of the respective segments.

In one embodiment, for example, when an optimal driving frequency for a first segment SEG11 is 10 Hz and optimal driving frequencies for the other segments SEG12 to SEG85 except for the first segment SEG11 are 2 Hz, the frequency adjuster may determine the low driving frequency to 10 Hz.

In an embodiment, the driving frequency determiner 230A may refer to the flicker value storage 240 and information SG of the segment of the display panel 100 to determine the low driving frequency.

In an embodiment, the driving frequency determiner 230A may determine the flicker values corresponding to the segments. The driving frequency determiner 230A may determine the driving frequency of the display panel 100 based on the flicker values corresponding to the segments and the play speed setting MD.

According to an embodiment, the frequency controller may determine the driving frequency based on the input image data IMG and the play speed setting MD. Thus, when the input image data IMG represents a static image or when the moving image having the play speed setting MD which is lower than 1.0 times, the driving frequency may be set to be lower than the input frequency. Thus, the power consumption of the display apparatus may be reduced.

In such an embodiment, the driving frequency of the display panel 100 is determined based on the degree of the flicker of the input image data IMG so that the display quality of the display panel 100 may be enhanced.

According to embodiments of the invention as set forth herein, the power consumption of the display apparatus may be reduced and the display quality of the display panel may be enhanced.

The invention should not be construed as being limited to the embodiments set forth herein. Rather, these embodiments are provided so that this disclosure will be thorough and complete and will fully convey the concept of the invention to those skilled in the art.

While the invention has been particularly shown and described with reference to embodiments thereof, it will be understood by those of ordinary skill in the art that various changes in form and details may be made therein without departing from the spirit or scope of the invention as defined by the following claims.

What is claimed is:

1. A display apparatus comprising:

a display panel which displays an image based on an input image data;

a data driver which outputs a data voltage to the display panel; and a frequency controller which determines a driving frequency of the display panel based on the input image data and a play speed setting, wherein the frequency controller comprises:

a play mode determiner which determines whether the play speed setting is less than 1.0 times;

a static image determiner which determines whether the input image data is a static image or a moving image when the play speed setting is equal to or greater than 1.0 times;

a flicker value storage which stores a flicker value with respect to a grayscale value of the input image data; and a driving frequency determiner which determines the driving frequency of the display panel based on the flicker value and the play speed setting.

2. The display apparatus of claim 1, wherein the driving frequency determiner comprises:

a first frequency determiner which determines a first frequency based on the flicker value;

a second frequency determiner which determines a second frequency based on the play speed setting; and a frequency comparator which compares the first frequency and the second frequency and determines that the driving frequency of the display panel is a greater value among the first frequency and the second frequency.

3. The display apparatus of claim 2, wherein the first frequency is determined based on the flicker value representing a degree of a flicker occurrence for the grayscale value of the input image data, and wherein when the degree of the flicker occurrence is high, the first frequency is set to be high, and wherein when the degree of the flicker occurrence is low, the first frequency is set to be low.

4. The display apparatus of claim 2, wherein the second frequency is determined by multiplying the play speed setting to an input frequency of the input image data, wherein when the play speed setting is high, the second frequency is set to be high, and wherein when the play speed setting is low, the second frequency is set to be low.

5. The display apparatus of claim 2, wherein when the play speed setting is less than 1.0 times, the driving frequency determiner determines the first frequency and the second frequency.

6. The display apparatus of claim 5, wherein when the play speed setting is less than 1.0 times and the first frequency is equal to or greater than the second frequency, the driving frequency determiner outputs a data signal to the data driver in the first frequency, and wherein when the play speed setting is less than 1.0 times and the first frequency is less than the second frequency, the driving frequency determiner outputs the data signal to the data driver in the second frequency.

7. The display apparatus of claim 1, wherein when the input image data is a static image and the play speed setting is less than 1.0 times, the driving frequency determiner determines the driving frequency of the display panel based on the flicker value.

8. A display apparatus comprising:

a display panel which displays an image based on an input image data;

a data driver which outputs a data voltage to the display panel; and a frequency controller which determines a driving frequency of the display panel based on the input image data and a play speed setting, wherein the display panel includes a plurality of segments, and wherein the frequency controller comprises:

a play mode determiner which determines whether the play speed setting is less than 1.0 times;

a static image determiner which determines whether the input image data is a static image or a moving image when the play speed setting is equal to or greater than 1.0 times;

a flicker value storage which stores a flicker value with respect to a grayscale value of the input image data; and a driving frequency determiner which determines the driving frequency of the display panel based on flicker values corresponding to the segments and the play speed setting.

9. The display apparatus of claim 8, wherein the frequency controller determines the flicker values of the respective segments and determines that the driving frequency of the display panel is a maximum driving frequency, in which a flicker is not shown to a user, based on the flicker values of the respective segments.

10. A method of driving a display panel, the method comprising:

determining a driving frequency of the display panel using a frequency controller; and outputting a data voltage to the display panel based on the driving frequency, wherein the frequency controller determines the driving frequency of the display panel based on an input image data and a play speed setting, wherein the determining the driving frequency of the display panel comprises determining a first frequency based on a flicker value with respect to a grayscale value of the input image data and a second frequency based on the play speed setting when the play speed setting is less than 1.0 times.

11. The method of claim 10, wherein the determining the driving frequency of the display panel comprises determining whether the input image data is a moving image or a static image when the play speed setting is equal to or greater than 1.0 times.

12. The method of claim 11, wherein the determining the driving frequency of the display panel further comprises:

determining that the driving frequency of the display panel is an input frequency of the input image data when the play speed setting is equal to or greater than 1.0 times and the input image data is a moving image; and determining the driving frequency of the display panel based on a flicker value with respect to a grayscale value of the input image data when the play speed setting is equal to or greater than 1.0 times and the input image data is a static image.

13. The method of claim 10, wherein the determining the driving frequency of the display panel further comprises:

determining that the driving frequency of the display panel is the first frequency when the play speed setting is less than 1.0 times and the first frequency is equal to or greater than the second frequency; and determining that the driving frequency of the display panel is the second frequency when the play speed setting is less than 1.0 times and the first frequency is less than the second frequency.

14. The method of claim 10, wherein the first frequency is determined based on the flicker value representing a degree of a flicker occurrence for the grayscale value of the input image data, and wherein when the degree of the flicker occurrence is high, the first frequency is set to be high, and wherein when the degree of the flicker occurrence is low, the first frequency is set to be low.

15. The method of claim 10, wherein the second frequency is determined by multiplying the play speed setting to an input frequency of the input image data, wherein when the play speed setting is high, the second frequency is set to be high, and wherein when the play speed setting is low, the second frequency is set to be low.

16. The method of claim 10, wherein the driving frequency of the display panel is determined based on a flicker value with respect to a grayscale value of the input image data when the input image data is a static image or the play speed setting is less than 1.0 times.

17. The method of claim 10, further comprising:

dividing the display panel into a plurality of segments; and determining flicker values corresponding to the segments, wherein the driving frequency of the display panel is determined based on the flicker values corresponding to the segments and the play speed setting.

* * * * *